US006745737B2

(12) United States Patent
Evans et al.

(10) Patent No.: US 6,745,737 B2
(45) Date of Patent: Jun. 8, 2004

(54) INTERNAL COMBUSTION ENGINE WITH AN ANTI-ROTATION GUIDE FOR VALVE LIFTERS

(75) Inventors: Matthew Evans, Warren, MI (US); David Groh, Troy, MI (US); Norbert Nitz, Hirschaid (DE); Oliver Schnell, Veitsbronn (DE)

(73) Assignee: INA-Schaeffler-KG, Herzogenaurach (DE)

( * ) Notice: Subject to any disclaimer, the term of this patent is extended or adjusted under 35 U.S.C. 154(b) by 0 days.

(21) Appl. No.: 10/178,039

(22) Filed: Jun. 21, 2002

(65) Prior Publication Data

US 2003/0070636 A1 Apr. 17, 2003

Related U.S. Application Data

(60) Provisional application No. 60/300,743, filed on Jun. 25, 2001.

(51) Int. Cl.[7] ..... F01L 1/14

(52) U.S. Cl. ..... 123/90.5; 123/90.48

(58) Field of Search ..... 123/90.15, 90.16, 123/90.27, 90.31, 90.48, 90.5, 198 F

(56) References Cited

U.S. PATENT DOCUMENTS

| | | | | | |
|---|---|---|---|---|---|
| 3,668,945 | A | * | 6/1972 | Hofmann | 74/569 |
| 4,693,214 | A | * | 9/1987 | Titolo | 123/90.18 |
| 5,678,514 | A | * | 10/1997 | Mazzella et al. | 123/90.5 |
| 6,257,189 | B1 | * | 7/2001 | Moretz et al. | 123/90.5 |
| 6,357,407 | B2 | * | 3/2002 | Brothers | 123/90.5 |

* cited by examiner

*Primary Examiner*—Thomas Denion
(74) *Attorney, Agent, or Firm*—Volpe & Koenig, P.C.

(57) ABSTRACT

In an internal combustion engine with a motor block (6) and a longitudinal extending anti-rotation guide (5), which includes receiving recesses situated at apportioned spatial distances, one from the other to receive valve tappets and is affixed in a receiving groove of the motor block (6). The guide (5) is constructed as an injection molded component with a one-piece, molded-on, elastically expanded or deformable clip, which engages in a complementary receiving contour on the motor block (6).

6 Claims, 5 Drawing Sheets

INTERNAL COMBUSTION ENGINE WITH AN ANTI-ROTATION GUIDE FOR VALVE LIFTERS

CROSS-REFERENCE TO RELATED APPLICATIONS

This application claims the benefit of U.S. Provisional Application No. 60/300,743, filed Jun. 25, 2001.

BACKGROUND

The invention concerns an internal combustion engine with a motor block and a longitudinally extended anti-rotation guide, which includes openings arranged sequentially at apportioned distances from one another, to receive valve lifters, and the anti-rotation guide is affixed in a receiving groove of the motor block.

Anti-rotation guides have been already installed in internal combustion engine for the orientation and the prevention of the turning of roller tappets. In such installations, the guide is fastened on the motor block with screws, as is disclosed by U.S. Pat. No. 5,088,455 wherein a known anti-rotation guide is described.

In DE 197 12 610 A1, wherein an anti-rotation guide of an internal combustion engine is presented, the explanation discloses that internal combustion engines normally possess roller tappets, which engage cam lobes of a cam shaft. The tappets are not to rotate about each of their respective axes, because the rollers on the tappets must remain in the same plane with the cam lobes. For this reason, the tappets in the cylinder block of the internal combustion engine are equipped with special holding devices in an appropriate manner and their rotation is prevented. In the case of the fastening of such a holding device with screws on the motor block, for the securement of the tappet against turning, the disadvantage can be mentioned, that for this installation, an additional assembly time is necessary. Besides that, additional costs arise because of the necessity of boring holes for the screws and to internally cut the required female threads.

In the publication DE 197 12 610, and on the given grounds, the proposal was made to attach an elastic pre-stressed element to the longitudinally extended body of the holding apparatus, in order to affix the apparatus between the cylinder block and the cylinder head. That disclosure provides is a leaf spring, serving as an elastic, pre-stressed element, which is accepted in a groove provided therefor in the anti-rotation guide.

SUMMARY

The invention has the purpose of reducing the number of construction components in an anti-rotation guide, where an internal combustion engine is concerned, and to simplify the assembly of the same.

This purpose will be achieved, in accordance with the invention, in that the guide is to be manufactured as an injection molded component. This component is to be molded as one piece, with an elastic, deflectable or deformable clip, which engages a complementary shape on a motor block. In this way, there is made available an alternative to the screwed fastenings customarily found on the anti-rotation guide. The use of a molded clip can be advantageous, if no space is available for a screw fastening. By means of a clipping connection of the anti-rotation guide in a complementary receiving means on the motor block, and the associated elimination of screw fastenings, there is brought about a less complicated assembly and inventory control of parts. Also, the addition to the motor block and the mounting of the guide thereon is simpler, so that the costs of these operations are reduced. Complementary contours can be designed into the anti-rotation guide, in such a way, that upon the mounting of the cylinder heads, the guide can be brought into its correct position and retained there. For compensation of tolerances, these complementary contours can be executed by at least one, reversely bent, spring yoke.

BRIEF DESCRIPTION OF THE DRAWINGS

Embodiments of the invention are shown in the drawing and are explained in more detail in the following. There is shown in.

DETAILED DESCRIPTION OF THE DRAWINGS

Figure 1:
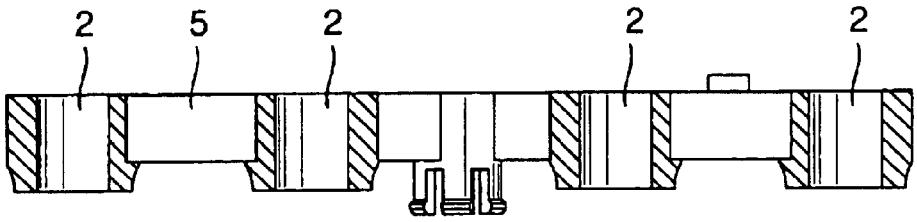
FIG. 1 is a profile view, partially in cross-section, of a first embodiment of an anti-rotation guide.
Figure 2:
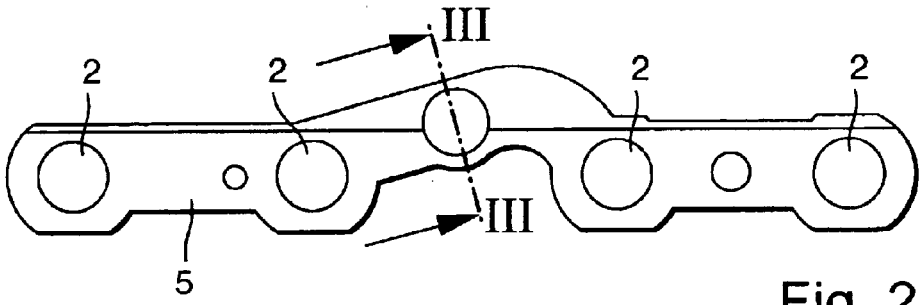
FIG. 2 is the guide of FIG. 1 in a plan view.
Figure 3:
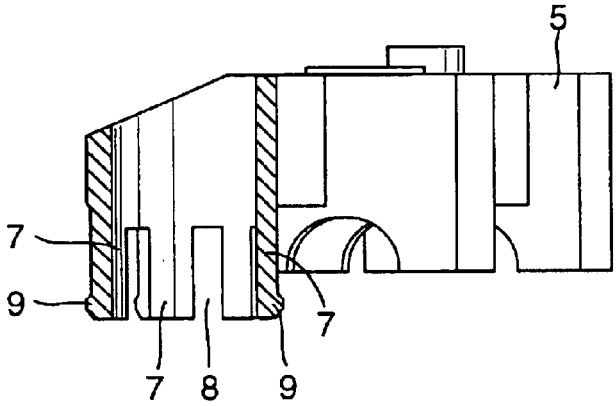
FIG. 3 is a section of the guide through line III—III of the FIG. 2.
Figure 4:
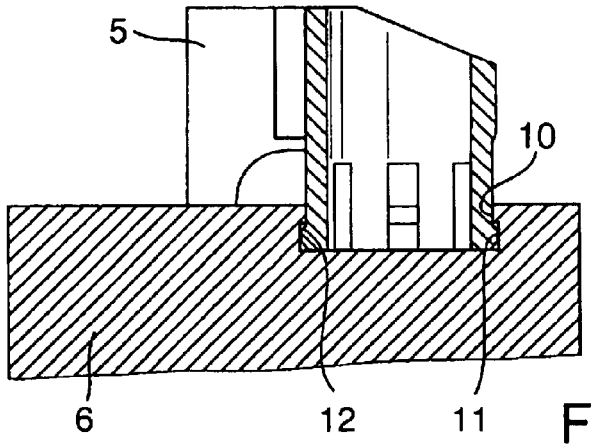
FIG. 4 is the fastening of the guide on the motor block.
Figure 5:
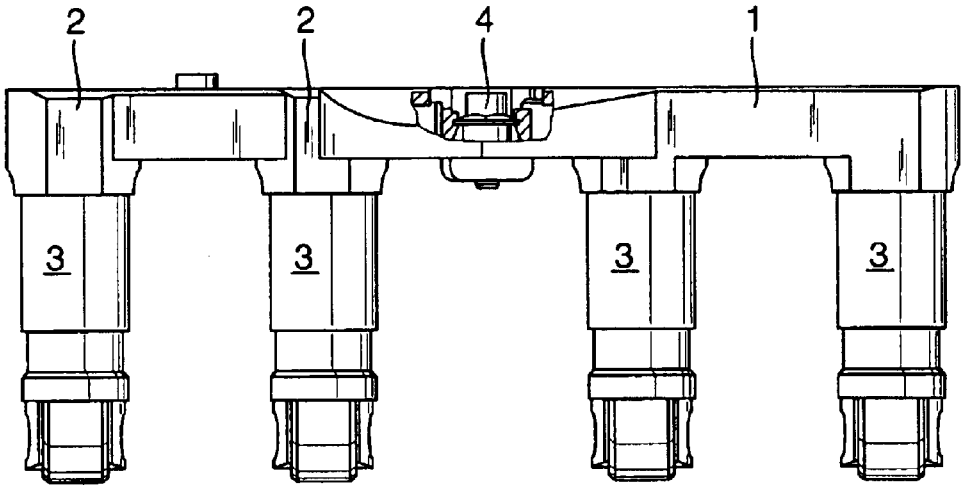
FIG. 5 is a profile view of an anti-rotation guide provided with valve tappets in accordance with the conventional state of the technology.
Figure 6:
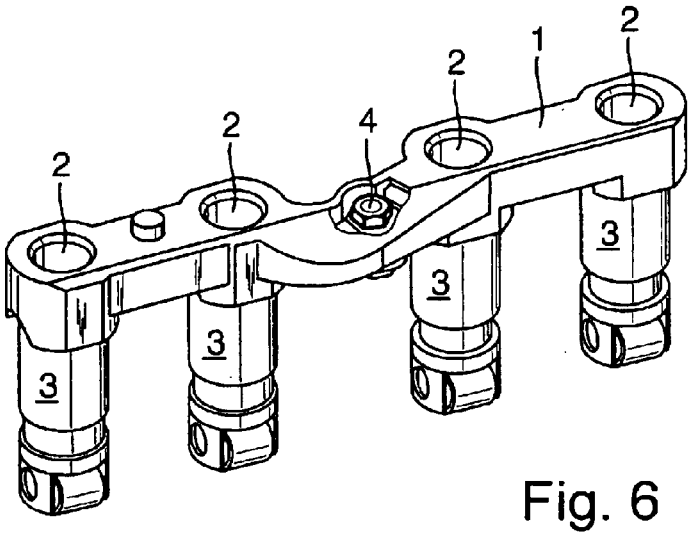
FIG. 6 is the guide of FIG. 5 in a perspective view.

An anti-rotation guide 1 in accordance with the previously known state of the art is shown in FIGS. 5 and 6 which includes four openings 2, arranged longitudinally, one after the other. In each opening 2, a valve tappet is held on one end. In the middle of the bridge 1 is located a screw, with which the bridge 1 can be secured to the motor block.

FIGS. 1 to 4 shown an anti-rotation guide 5 in accordance with the invention, in which a screw connection is not required. Instead of this, the fastening of the guide 5 on a motor block 6 is carried out by means of a clip. This clip is molded on the guide 5 in the middle and is thus made as one piece with the guide 5. The clip is shaped similar to a tube or tube fitting and comprises a plurality of resilient tongues 7 which are separated from one another by slots 8. In accordance with their cylindrical shape, the tongues 7 are circularly arranged, in a circumferential manner, one after the other. On the free end of each tongue 7 is a radially outwardly extending catch protrusion. The fastening of the guide 5 on the motor block 6 is carried out, when the molded tongues of the clip are pushed so far into a receiving boring 10 of the motor block 6, that their catch protrusions 9 engage in a receptive inner circumferential groove, which is formed within the receiving boring 10 in the motor block. An annular, inner detent projection, against which the catch protrusions 9 axially lie, then prevents the release of the guide 5 from the motor block 6.

Otherwise, the guide, with its tappet recesses 2 is made identical to the conventional bridge 1 depicted in FIGS. 5 and 6.

Figure 7:
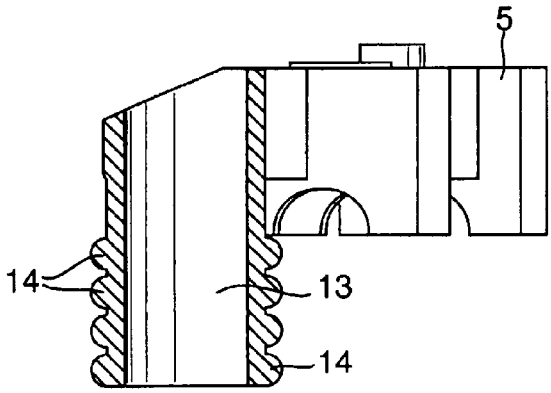
FIG. 7 is a second embodiment of the guide in a presentation similar to that of FIG. 3.
Figure 8:
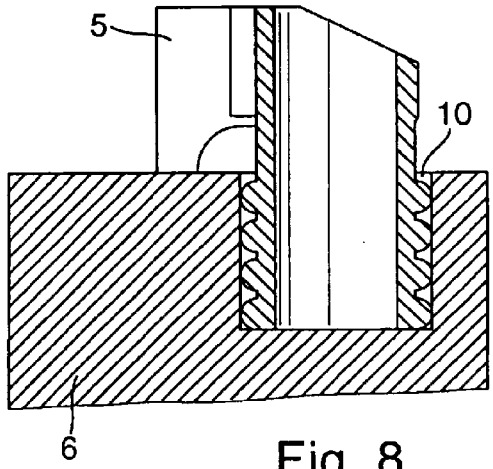
FIG. 8 is a view showing the fastening of the guide of FIG. 7 onto the motor block.

In the case of the embodiment in accord with the FIGS. 7 and 8, there is found on the guide 5 as a clip, a tube fitting 13, on the outer, upper surface of which is furnished a plurality of rounded, ringlike circumferential bands 14, located axially one after the other. The fastening of the guide 5 onto the motor block 6 is made possible, in that the ring bands 14, which are over dimensioned, clamp themselves into the cylindrical receiving boring 10 of the motor block 6.

Figure 9:
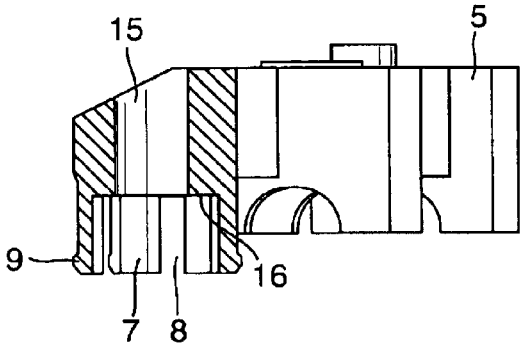
FIG. 9 is a third embodiment of the anti-rotation, in a presentation similar to that of FIG. 3.
Figure 10:
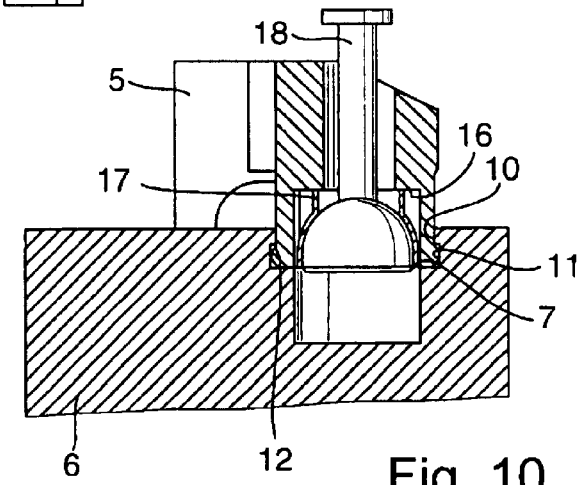
FIG. 10 is a view showing the fastening of the guide of FIG. 9 on the motor block.

FIGS. 9 and 10 show a guide 5, the clip of which is formed by the tongues 7 and the slots 8, and includes an inside diameter, which is greater than the inside diameter of an adjacent boring 16 in the guide 5, with the boring having at least two stages. In this way, in the guide 5 and in the staged boring an annular detent surface 16 is formed. For the assured fastening of the guide 5 on the motor block 6, a hollow rivet is inserted in the staged boring which abuts itself axially on the detent surface 16. By he drawing of a die 18 through the hollow rivet 17, the hollow rivet is widened radially, so that it is retained axially on the detent surface 16. By means of the radial widening of the hollow rivet 17, the tongues 7 are wedged into the socket 11 of the motor block 6, whereby the fastening of the guide 5 on the motor block 6 is accomplished.

Figure 11:
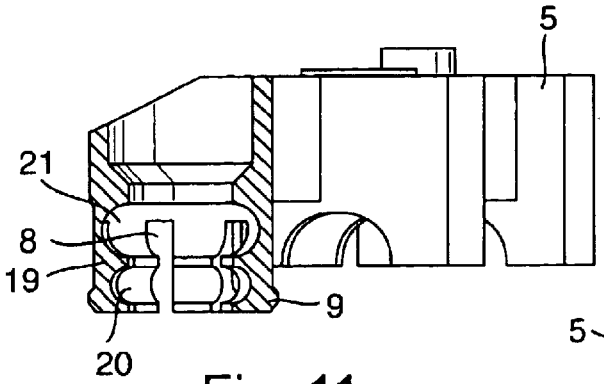
FIG. 11 is a view of a fourth embodiment of an anti-rotation guide, in a presentation similar to that of FIG. 3.
Figure 12:
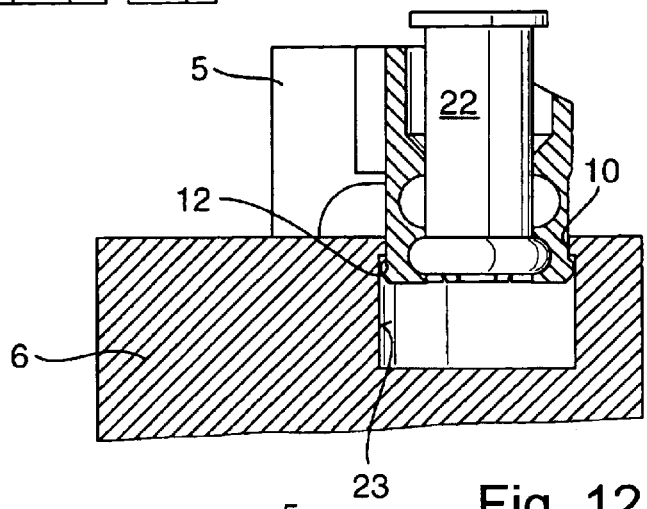
FIG. 12 is a view showing the fastening of the guide of FIG. 12 on the motor block.

In the case of the embodiment in accordance with FIGS. 11 and 12, tongues 19 are molded parts of the guide 5, which include within the slotted tube a smaller diameter, inner, circumferential groove 20 and axially thereover, a larger diameter inner, circumferential groove 21. In the interior of the slotted tube there runs a die 22, the widened contour of which is found, on the assembly of the guide 5, within the greater, inner, circumferential groove 21. Thus the clip of the guide 5 can be introduced into the receiving boring 10. For the fastening, the die 22 is pressed downward, so that the widened shape of the same penetrates into the smaller inner circumferential groove 20. By this means, the tongues 19 of the clip are wedged into the socket 23 of the motor block 6, whereby the guide 5 is fastened to the motor block 6.

Figure 13:
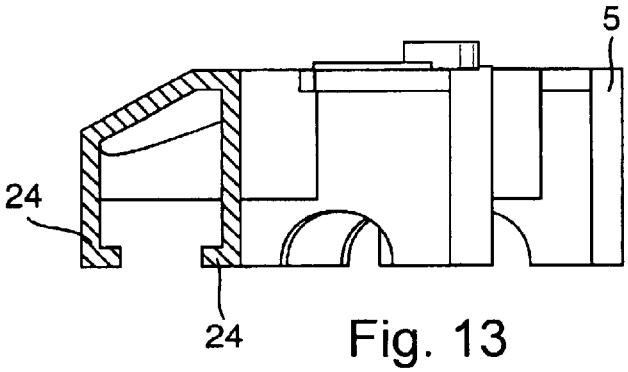
FIG. 13 is a fifth embodiment of an anti-rotation guide, in a presentation similar to that of FIG. 3.
Figure 14:
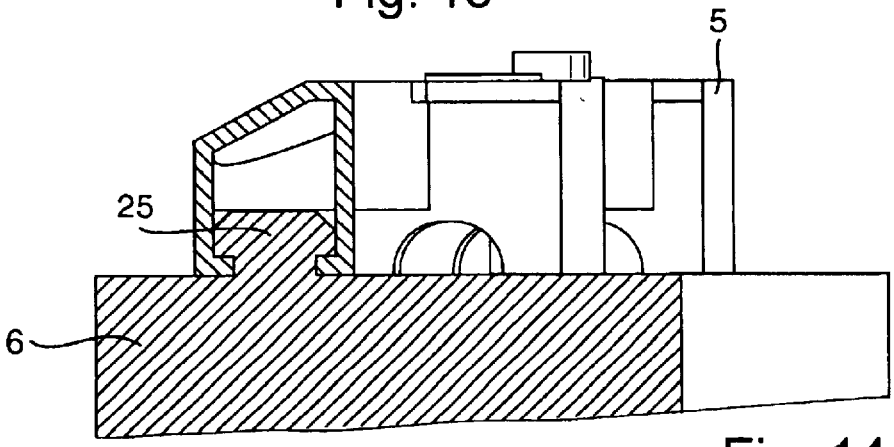
FIG. 14 is a view showing the fastening of the guide of FIG. 13 on the motor block.

On the guide 5 in the FIGS. 13 and 14, the angle tongues 24 are molded parts. The guide 5 is fastened to the motor block 6 through the engagement of these angular tongues in a complementary negative contour, which is formed on a retaining protrusion of the motor block 6.

Figure 17:
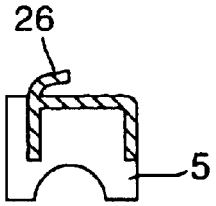
FIG. 17 is a section view through the guide taken along line XVII—XVII of the FIG. 15, in enlarged scale.
Figure 15:
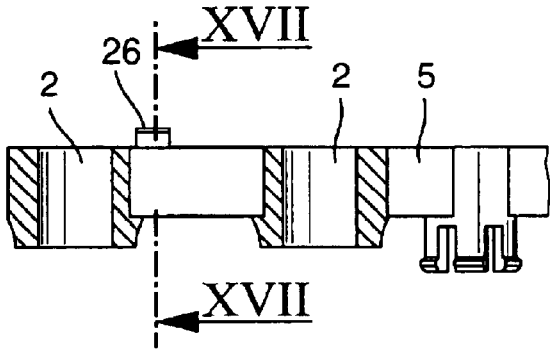
FIG. 15 is a profile view showing the partial presentation of an anti-rotation guide provided with an additional spring clip.
Figure 16:
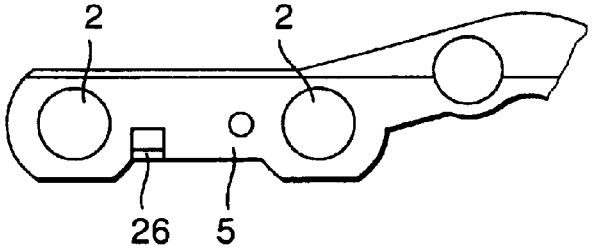
FIG. 16 is a plan view of the guide of FIG. 15.

The guide 5 can, additionally, be held on the upper side in its position, since it abuts the cylinder head which lies thereover. One or more spring yokes 26 can serve for the compensation of tolerances, between the cylinder head and the guide 5, as is evident in the FIGS. 15, 16 and 17. The combination with the spring yoke 26 can be given consideration with all possible embodiment variants. The spring yokes 26 can be mated with elastic material, such as rubber.

1 Anti-rotation guide
2 Tappet opening
3 Valve tappet
4 Screw
5 Anti-rotation guide
6 Motor Block
7 Flap
8 Slot
9 Projecting rim
10 Boring
11 Socket
12 Retaining surface
13 Tube fitting
14 Ring projections
15 Boring
16 Detent surface
17 Hollow rivet
18 Die
19 Flap
20 Smaller inside circumferential groove
21 Larger inside circumferential groove
22 Die
23 Socket
24 Angled tongue
25 Holding projection
26 Spring yoke

What is claimed is:

1. An internal combustion engine with a motor block (6) and a longitudinally extending anti-rotation guide (5) including spaced apart receiving openings (2) adapted to receive valve tappets, the anti-rotation guide (5) is fastened in a receiving groove of said motor block (6), the guide (5) is constructed as an injection molded component with a one-piece, molded on. elastic outwardly expanding or deforming tubular clip which engages in a matching motor block receptacle; and the clip is formed from a plurality of tongues (7) disposed in a tubular arrangement, which are circumferentially separated from each other by axial parallel slots (8) and include on their free ends radially projecting rims (9).

2. An engine in accordance with claim 1, wherein the guide (5) is a plastic component.

3. An engine, in accordance with claim 1, wherein the guide (5), in the hollow space formed for the tongues (7) of the clip, an annular detent surface (16) for an inserted hollow rivet (17) is constructed.

4. An engine in accordance with claim 1, wherein on the motor block (6) a protruding holding projection (25) is constructed, which is engaged from behind by the tongues from the guide (5).

5. An internal combustion engine with a motor block (6) and a longitudinally extending anti-rotation guide (5) including spaced apart receiving openings (2) adapted to receive valve tappets, the anti-rotation guide (5) is fastened in a receiving groove of said motor block (6), the guide (5) is constructed as an injection molded component with a one-piece, molded on, elastic outwardly expanding or deforming tubular clip which engages in a matching motor block receptacle;

a receiving boring (10) for accepting the clip is located in the motor block (6), and the guide (5) includes at least one spring yoke (26) for assisting in adjustably retaining the guide (5).

6. An internal combustion engine with a motor block (6) and a longitudinally extending anti-rotation guide (5) including spaced apart receiving openings (2) adapted to receive valve tappets, the anti-rotation guide (5) is fastened in a receiving groove of said motor block (6), the guide (5) is constructed as an injection molded component with a one-piece, molded on, elastic outwardly expanding or deforming tubular clip which engages in a matching motor block receptacle;

a receiving boring (10) for accepting the clip is located in the motor block (6); and the motor block (6) is fabricated with a socket (11) for the clip, by which an annular retaining surface (12) for the projecting rims (9) of the clip is formed.

* * * * *